US005255959A

United States Patent [19]

Loegel

[11] Patent Number: 5,255,959

[45] Date of Patent: Oct. 26, 1993

[54] TWIN-JET PROCESS AND APPARATUS THEREFOR

[76] Inventor: Charles Loegel, 7 Rue des Cochers, F-67340 Lichtenberg, France

[21] Appl. No.: 681,517

[22] PCT Filed: Apr. 9, 1990

[86] PCT No.: PCT/EP90/00557

§ 371 Date: May 6, 1991

§ 102(e) Date: May 6, 1991

[87] PCT Pub. No.: WO90/14200

PCT Pub. Date: Nov. 29, 1990

[30] Foreign Application Priority Data

May 16, 1989 [DE] Fed. Rep. of Germany ..... 3915933

[51] Int. Cl.[5] ..... E21B 10/60; E21C 25/60

[52] U.S. Cl. ..... 299/17; 239/128; 175/424

[58] Field of Search ..... 299/16, 17; 175/67, 175/424; 239/291, 13, 128, 418; 51/321, 427, 429

[56] References Cited

U.S. PATENT DOCUMENTS

| | | | |
|---|---|---|---|
| 4,074,858 | 2/1978 | Burns et al. | 299/17 X |
| 4,708,214 | 11/1987 | Krawza et al. | 299/17 X |
| 4,795,217 | 1/1989 | Hilaris | 299/17 X |
| 5,052,756 | 10/1991 | Wada et al. | 299/17 |

*Primary Examiner*—David J. Bagnell

*Attorney, Agent, or Firm*—Wallenstein, Wagner & Hattis, Ltd.

[57] ABSTRACT

In particular for cutting working of especially hard rock such as granite, an additional cooling medium is supplied to a pressure medium which is at a high pressure of especially more than 1500 bar. The pressure medium is ejected particularly in the form of discrete narrow jets from a nozzle head (5) and the directional jet (5*g*) of the cooling medium is directed towards at least some of the jets (5*b*) of the bundle of jets of the pressure medium so that together with the pressure medium a cooling effect is caused on the object to be worked, thus resulting in an improved crushing effect.

21 Claims, 4 Drawing Sheets

TWIN-JET PROCESS AND APPARATUS THEREFOR

FIELD OF THE INVENTION

The invention is directed to a method of and an apparatus for cutting, drilling and similar material-removing treatment of rock, ore, coal, concrete or other hard objects by means of a pressure medium.

BACKGROUND OF THE INVENTION

Such a method and such an apparatus have already been known (DE-A-3,739,825). In the nozzle head of this apparatus, individual nozzles are arranged at a setting angle relative to the direction of the main jet of the nozzle head so as to achieve a comparatively wide "scattering" of the bundle of discrete jets before the same "fan out" to such an extent that the marginal areas of the discrete jets will overlap.

In this connection it has also been known with other apparatus of similar species (DE-B-3,410,981 and 3,516,572) to employ cutting metal inserts for the nozzles and to anchor the same in the nozzle head by screwing-down or push-fitting.

Moreover, apparatus for drilling holes in concrete and rock have been known (MACHINE DESIGN 57/1985, pp.114–117), in which water jets mixed with abrasive particles are highly pressurized and are used for drilling by means of a rotating nozzle head, wherein a water pressure of approximately up to 100 bar is used.

Finally, it has also been known (CH-A-370,717 and GB-A-718,735) to atomize a liquid by means of air for the treatment of surfaces; here, too, rotary nozzles are employed by means of which the inner wall of the bore in a workpiece is treated to cause said bore to adopt the final fine-machining condition. Hence, a proper material-removing cutting effect is not obtained thereby.

SUMMARY OF THE INVENTION

It is the object of the invention to improve the machining especially of hard objects by removing material to form grooves or channels at a high removal rate without any bulky auxiliary units; it is particularly desirable to increase the "advance rate" when channelling the hard material.

Surprisingly, it has been found that by the method according to the invention, in which together with at least one jet of pressure medium at least one directional jet of a coolant is directed to the removal site of the object, a cooling effect acts on said object whereby the removal rate is substantially increased over the rate possible without such a cooling medium. The cooling medium need not necessarily be cooler than the pressure medium; it will suffice for the cooling medium to cause a strong cooling effect at the point of impact within the area of impact of the pressure medium jet on the object to be channelled. The removal rate will be improved for instance by the factor 3–4 relative to the absence of cooling medium even if water is used as pressure medium and air is used as cooling medium provided the water pressure is at least 1500 bar. It is assumed that due to the combination of the high-pressure water and the directional jet or several directional jets of air, respectively, sufficient heat is absorbed from the water already before the water impacts hard granite, for example, so that any substantial heating of the granite may be prevented. Investigations have shown that in the absence of the cooling medium the granite at the bottom of the channel formation will be heated to such an extent that a vitreous or ceramic-like coating is formed thereon whereby the removal rate is significantly reduced. The invention prevents the formation of such a coating on the granite top surface, which coating offers high resistance to removal. Moreover, the interaction between the point-like pressure-medium jets, which cause considerable heating of the rock upon impact, and the directional jet which cools the same part of the rock during oscillatory movement thereover promotes the formation of cracks in the rock and helps to break it up and crush it to particles.

The object of the invention is solved in a particularly advantageous way when the pressure medium is ejected from a nozzle head at the high pressure of up to 2000 bar and more in the form of plural narrow discrete jets and when the discrete narrow jets are not arranged in parallel but are arranged in the form of a bundle of jets which are divergent with increasing distance from the face of the nozzle head. In this connection it is especially suitable when the density (per unit of area) of the jets in the central part of the bundle is substantially higher than in the marginal area thereof.

Moreover it is desirable when directional jets of the cooling medium are directed towards the jets of pressure medium so that directional jets and discrete jets of pressure medium will intersect. Even if the cooling medium jets are deflected from the initial direction of the directional jet by discrete jets of the high-pressure medium, there will be a strong cooling effect because the velocity of the pressure medium jets is extremely high and amounts to more than 2000 km/h. When air is used as the cooling medium a pressure within the range of from 1 to 10 bar will suffice. Ice-forming effects will promote crushing in the area of impact on the rock.

Instead of air it is possible at least partly to use a cool liquefied gas whereby the results are further improved although the process costs will increase considerably.

For the rest, it is also possible to add abrasive particles especially to the cooling medium and/or to the pressure medium.

It is especially preferred to solve the specified object by an apparatus in which the nozzle head for the pressure medium and a directional head for the cooling medium are disposed side-by-side so that the above-mentioned effect is brought about. In this connection it is especially desirable when at least the nozzle head for the pressure medium performs an oscillatory motion in a plane of oscillation which corresponds to the longitudinal direction of the channel to be removed from the rock or similar hard object. The individual jets of pressure medium are disposed at different setting angles relative to said plane of oscillation. It is furthermore desirable to use nozzles which prevent spreading of the discrete jets already shortly after ejection from the nozzle head. Rather, the discrete jets should impact the object substantially in point-fashion, line-fashion in case of an oscillating movement, unless the cooling medium has an "ice-forming" effect on the pressure medium jets. The setting angles amount especially up to 25° relative to the plane of oscillation. Appropriately, the pressure medium supply conduit should be flexible while the cooling medium supply conduit may be rigid.

Below, the invention and especially preferred embodiments thereof will be explained in detail with reference to the drawings, in which

DESCRIPTION OF THE PREFERRED EMBODIMENTS

Figure 1:
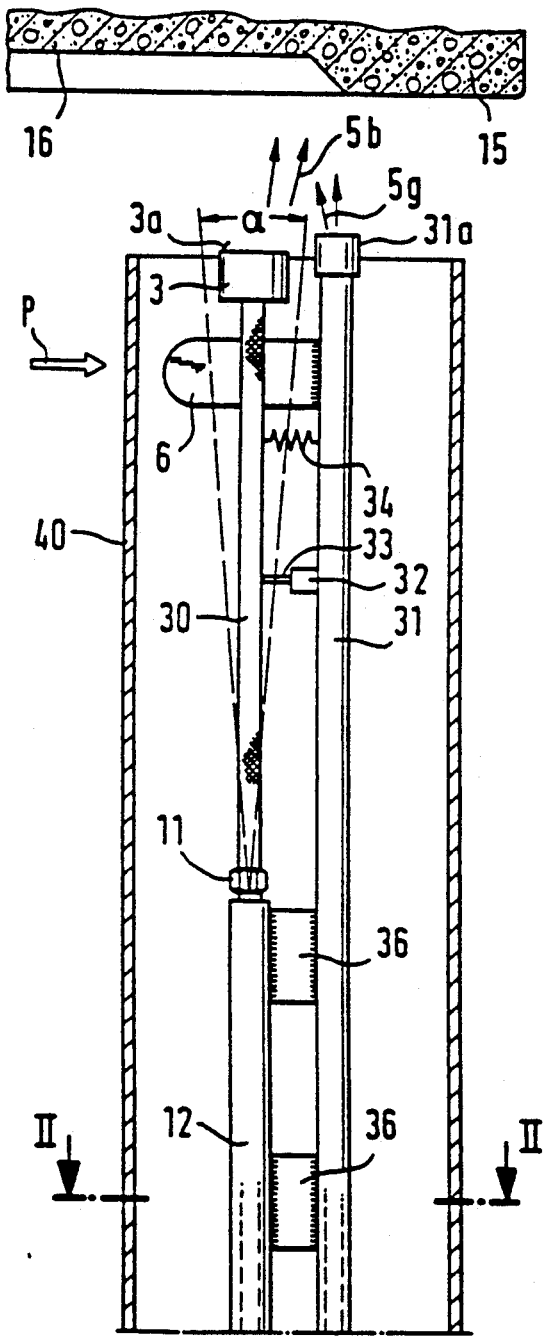
FIG. 1 is a schematic view of an apparatus according to the invention.
Figure 3:
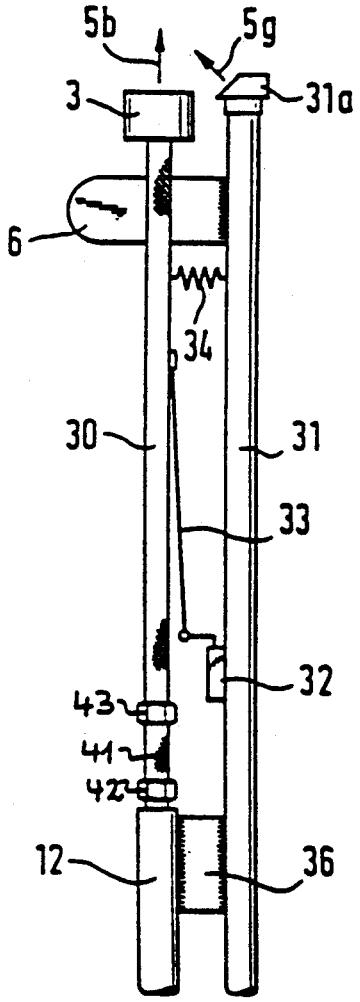
FIG. 3 is a schematic plan view according to FIG. 1 showing another embodiment of the apparatus.
Figure 2:
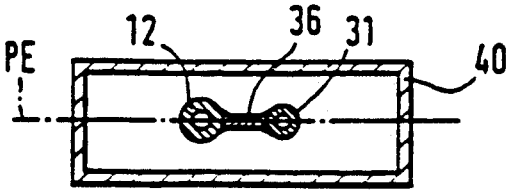
FIG. 2 is a schematic sectional view along the line II—II of the apparatus illustrated in FIG. 1.

As illustrated in FIG. 1, a rigid pressure medium supply conduit 12 is joined by connecting webs 36 to the likewise rigid cooling medium supply conduit 31. Both the pressure medium supply conduit 12 and the cooling medium supply conduit 31 are pipes disposed in parallel relationship. The free end of the pipe 12 has a coupling 11 fitted thereon for connecting the pressure medium supply conduit 30 which is a flexible oscillatory pipe to the pipe 12 in such a way that the oscillatory pipe may be caused to oscillate pendulum-fashion about the fitting location of the coupling 11, as indicated in dashed lines, for instance about an angle $\alpha$ of oscillation. Instead of the coupling 11 it is possible for instance as shown in FIG. 3 to fit a high-pressure hose between the pipe 12 and the oscillatory pipe so that the pressure medium flows through the flexible high-pressure hose which will not impede the oscillatory motion of the oscillatory pipe, i.e. the pressure medium supply conduit 30, in operation.

The supply conduit 30 which oscillates in operation is supported by a guide member 6 that projects laterally from the cooling medium supply conduit 31. The free end of the oscillatory pipe carries the nozzle head 3 having nozzles (not illustrated in the figure) disposed on the front face 3*a* thereof through which in operation pressure medium may be ejected towards the rock 15 in the form of jets 5*b*. The pendulum motion or, respectively, the oscillatory motion of the oscillatory pipe and hence also of the nozzle head 3 carried thereon and of the jets 5*b* to right and left about the angle $\alpha$ of oscillation is caused in this embodiment by a drive unit 32, for example, which is mounted on the cooling medium supply conduit 31 and can be driven by an energy carrier such as kinetic, electric, electromagnetic, pneumatic or hydraulic energy which is supplied through the supply pipe 31 to the drive unit 32. A plunger 33 pushes the oscillatory pipe temporarily in the direction away from the supply conduit 31, whereby the spring 34 is tensioned which on the one hand prevents excessive deflection of the oscillatory pipe and on the other hand retracts it in opposite direction. Due to the combined action of the drive unit 32 and the spring 34 on the oscillatory pipe the latter oscillates between the dashed lines. The narrow jets 5*b* hit the rock 15 where they remove material to form a channel 16 as the apparatus is progressively guided along the front of the rock 15 in the direction of the arrow P.

In the vicinity of the nozzle head 3 for the high-pressure medium the free end of the supply conduit 31 carries the directional head 31*a* through which directional jets 5*g* of air serving as cooling medium are directed towards the rock 15 and also towards the individual pressure medium jets 5*b*.

This apparatus is protectively enclosed by the schematically illustrated casing 40 with the exception of the open end thereof.

In the alternative apparatus illustrated in FIG. 3, a linkage composed of plural levers is used instead of the plunger 33 whereby the drive unit 32 causes the pressure medium supply conduit 30 to perform the oscillating motion. The directional jet 5*g* is inclined at 45° to the direction of the main jet of pressure medium, which direction is illustrated by the jet 5*b* from the nozzle head 3; in this embodiment the other pressure medium jets are not indicated.

Figure 4:
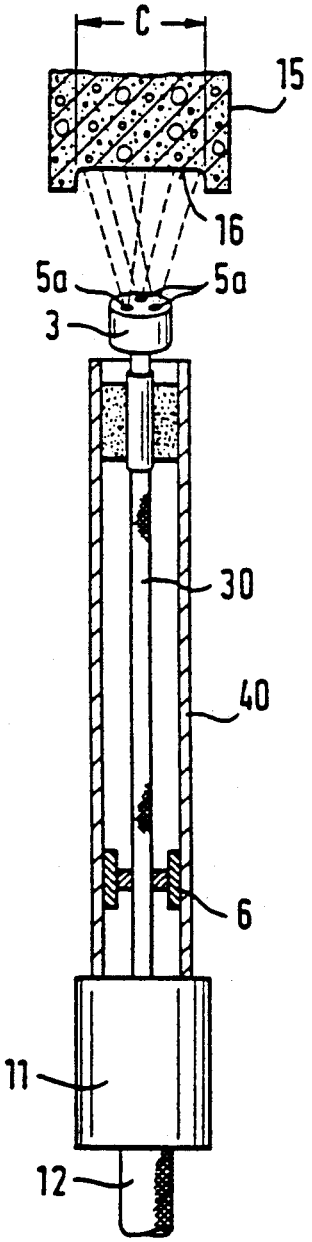
FIG. 4 is a fragmentary cross-sectional view of an apparatus according to the invention, without the directional head for the cooling medium, showing a cross-section of the channel formation in granite.

FIG. 4 illustrates schematically the width C of the channel 16 to be removed from the rock 15. The nozzle head 3 is provided with nozzles 5*a* for the pressure medium which may optionally also be in the form of conical jets fanning out with increasing distance from the nozzle head 3, although narrow discrete jets have been found to be much more satisfactory.

Figure 5:
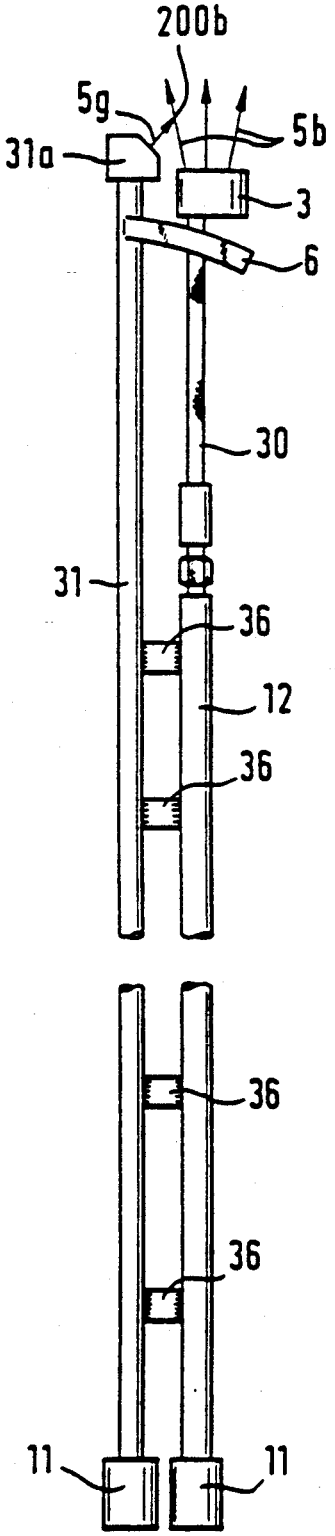
FIG. 5 is a schematic elevation illustrating another embodiment of the invention.

The embodiment illustrated in FIG. 5 is the most preferred one; the pressure medium ejected at high pressure from the nozzle head 3 in the form of narrow discrete jets 5*b* is used for automatically driving the flexible oscillatory pipe or supply conduit 30 in the direction which is predetermined by the bracket-like and especially straight guide member 6. Here, the plane of oscillation is in the plane of the drawing, i.e. in the same plane where the pressure medium supply conduit 12, on the one hand, and the cooling medium supply conduit 31, on the other hand, are disposed. This embodiment of the invention also provides that at least one directional air jet 5*g* serving as cooling medium exits from the directional head 31*a* in such a way that there results at least a fictitious point of intersection 200*b* with the next-adjacent jet 5*b* of pressure medium before the rock (not illustrated) is reached.

Figure 6:
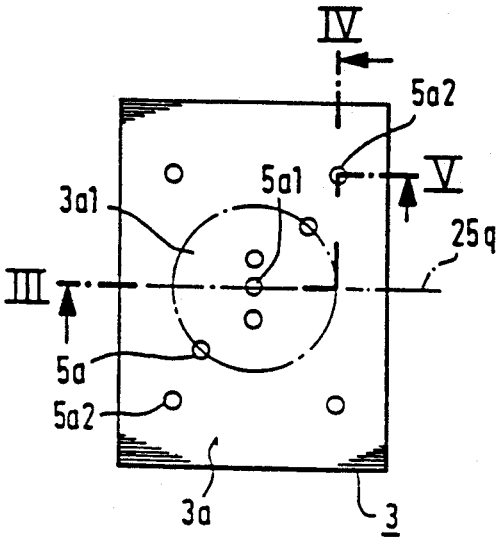
FIG. 6 is a plan view of the end face of a nozzle head.
Figure 7:
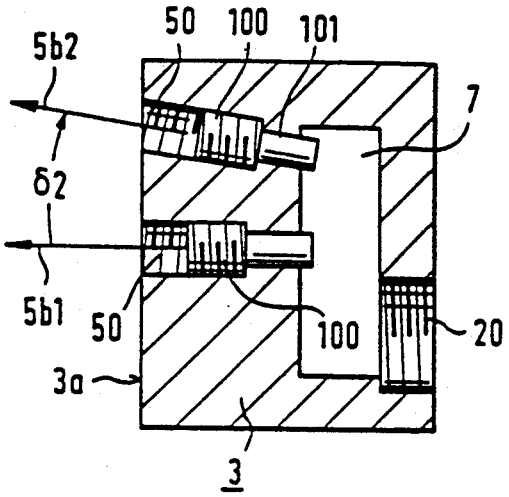
FIG. 7 is a cross-section III—IV of FIG. 6.
Figure 8:
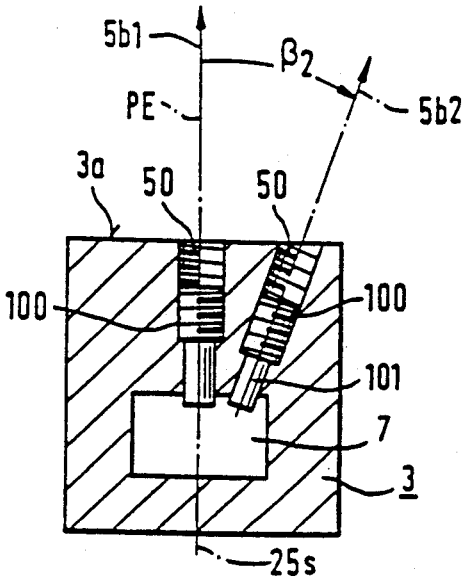
FIG. 8 is a cross-section III—V of FIG. 6 illustrating the nozzle head.
Figure 9:
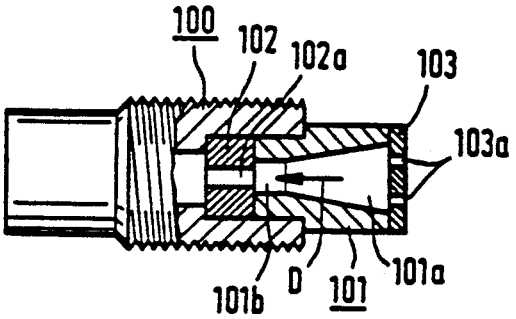
FIG. 9 is a fragmentary cross-section of a nozzle.

The FIGS. 6, 7 and 8 illustrate an especially preferred embodiment of a nozzle head. The rectangular nozzle head 3 is provided at its free front face 3*a* with a number of nozzles 5*a* of which the centre nozzle 5*a*1 is disposed at the point of intersection between the plane of symmetry 25*s* (which at the same time constitutes the plane of oscillation PE) and the transversal plane 25*q* extending at right angles thereto. In the central area 3a1 around the centre nozzle 5*a*1 further nozzles 5*a* are disposed so that the density, i.e. the number of nozzles per unit of area, in the central area 3*a*1 is higher than outside thereof. The outermost nozzles 5*a*2 are constituted by nozzle elements which will be explained in detail with reference to FIG. 9.

Within the nozzle head 3 there are provided holes with internal threads 50 starting from the end face 3*a* in such a way that the axes of the holes are inclined at setting angles $\beta$ and $\delta$ relative to the axis of the centre nozzle 5*a*1 and hence to the direction of the main jet. Therefore, starting from the end face 3*a* of the nozzle head 3, the jets 5*b*2 extend diametrically outwardly. It is recommended that the getting angle in the plane of oscillation PE should be significantly larger than the setting angle $\beta$ in the transversal plane 25q crossing it. In this example the first-mentioned setting angle $\delta_2$ is 23° whereas the second-mentioned setting angle $\beta_2$ is 6°. The nozzle elements are constituted by the threaded bolts 100 which are screwed from the end face 3a into the internal threads 50, and the cylindrical extensions 101 conveniently protrude right into the collecting chamber 7 within the nozzle head 3. The collecting chamber 7 is communicated with the pressure medium supply conduit 30 (not illustrated in FIG. 7) via a passageway formed with internal threads 20. The internal diameter of the nozzles 5a in the vicinity of the through-opening 102a is 0.5–1 mm.

Appropriately, the threaded bolt 100 which is especially made from steel is provided with an annular insert 102 made especially from sapphire and/or cutting metal the through-opening 102a of which has the smallest cross-section of passage of all of the aggregate units taking part in passing the pressure medium therethrough. The extension 101 of the threaded bolt 100 has a cross-section of passage which decreases at a taper in the flow direction D of the pressure medium. A perforated disk 103 is attached as by welding to the entry portion of the extension 101. The overall cross-section of all perforated holes 103a in the disk 103 is greater than the cross-section of passage of the through-opening 102a of the annular insert 102. Part of the extension 101 is contiguous with the insert 102 which has a substantially cylindrical bore 101b which is followed by the conical collecting chamber 101a. The perforated disk 103 reduces pressure pulsations especially in combination with the conically narrowing collecting chamber 101a. It is thereby ensured more reliably that the discrete jets 5b1, 5b2 of pressure medium remain narrow right to the point of impact on the object to be worked. Alternatively, either the pressure medium and/or the cooling medium may be subjected to pressure pulsations.

Figure 10:
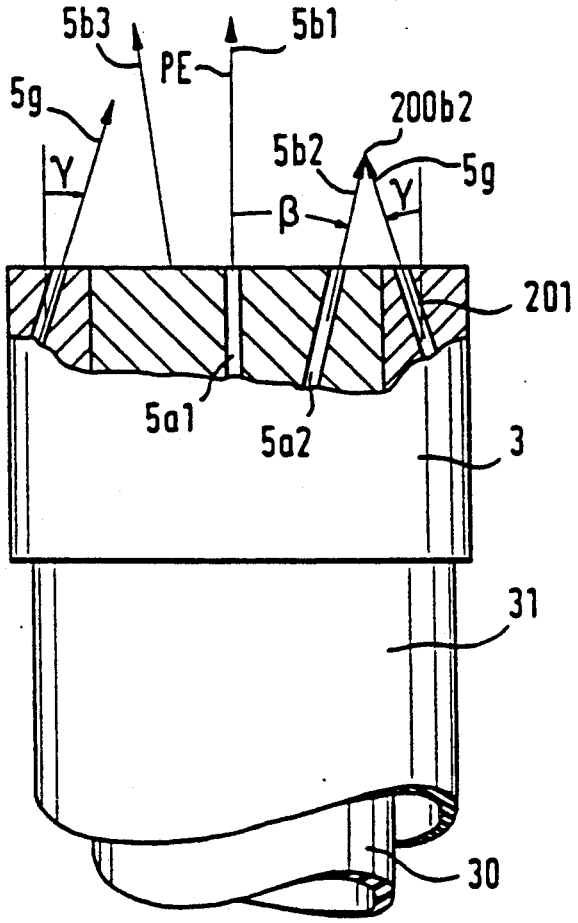
FIG. 10 is a cut-away side view of another nozzle head.

In the special embodiment shown in FIG. 10 the cooling medium supply conduit 31 encloses the pressure medium supply conduit 30 in coaxial relationship; both supply conduits are flexible, wherein the pressure medium supply conduit 30 is a high-pressure hose since the medium pressure internally thereof is very high. As the pressure medium is ejected through the nozzles, in this case the nozzles 5a1 and 5a2, and pressure medium jets 5b1, 5b2, 5b3 are formed and the nozzle head 3 oscillates rapidly in the plane of oscillation PE, i.e. normal to the plane of the drawing, the bundle of jets which is formed by the extremely narrow discrete jets 5b1, 5b2, 5b3 and opgionally further discrete jets is enveloped by a kind of air "curtain", said air flowing as said cooling medium through the annular directional nozzle 201. The axis of the directional nozzle 201 is oriented radially inwardly at the setting angle $\gamma$ of about 20°, and consequently the jet 5b2, which is inclined to the central jet 5b1 at the setting angle $\beta$, is in any case fictitiously hit or intersected by the directional jet 5b at the point of intersection 200b2. Actually, the directional jet 5g of cooling medium is deflected about the jet 5b2 which is ejected from the nozzle 5a2 at a very high velocity of, for example, 2000 km/h.

By the way, it has been found that it is not always necessary for directional jets 5g to intersect pressure medium jets 5b already before the same hit the object 15, although such "contact" between the cooling medium, for instance the air of the directional jet 5g, and the high-pressure medium results in a strong cooling effect already prior to hitting the rock 15.

Figure 11:
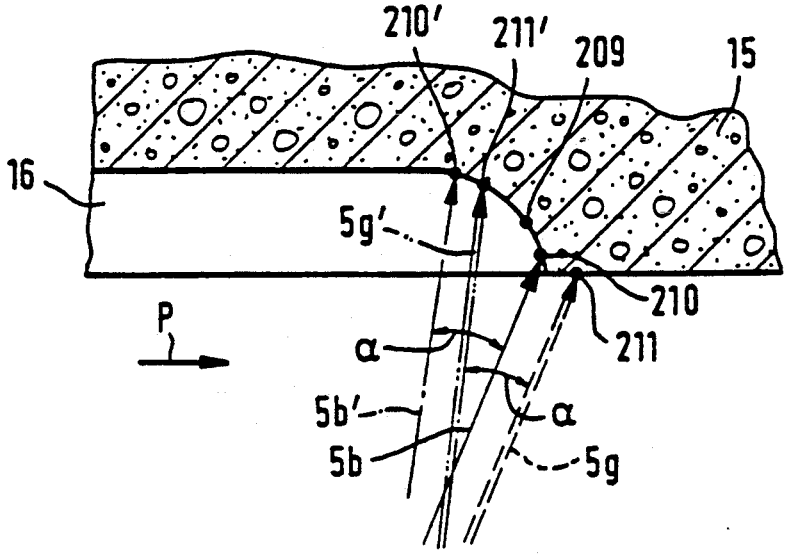
FIG. 11 is a schematic illustration of the rock crusher.

As shown in FIG. 11, the directional jet 5g does not directly combine with the pressure medium jet 5b; rather, the directional jet 5g and the pressure medium jet 5b are swung substantially in parallel side-by-side relationship during the pendulum-like oscillatory motion of the nozzle head 3 about the oscillating angle $\alpha$ from one position to, the other position indicated in dashed lines, in which the directional jet is referenced 5g' and the pressure medium jet is referenced 5b'. Due to the high energy with which the jet 5b, 5b' of pressure medium, for example water, hits the granite rock 15 at a pressure of 2000 bar in the impacting area 209 where the channel 16 starts at the points of impact 210, and shortly afterwards 210', there results a sudden heating-up of the granite rock by the high-energy pressure medium jets 5b, 5b'. Shortly afterwards directional jets 5g' of air contact the same impacting area 209 for instance at the point of impact 211' with a resultant abrupt considerable temperature decrease. This rapid alternation between heating and cooling within a very short time of less than one second and within short areas leads to a practically explosive crack formation in the rock so that particles are actually chipped off. Hence, the removal efficiency in the area of impact 209 is higher by a multiple than in the case of pressure medium jets 5b, 5b' which merely oscillate thereat. With many types of rock the heating without intermediate cooling (without making use of the cooling directional jets) leads to the formation of a coating acting as a thermal shield exactly in the area of impact, whereby the action of the high-energy jets 5b, 5b' is reduced during prolonged operation as compared with the starting phase of removal when the rock is not yet greatly heated.

The invention can be employed to particular advantage for forming straight or arcuate or even circular channels in granite and similar hard rock. Thus, the apparatus according to the invention is capable of cutting channels of a depth of up to one meter in granite so that granite blocks of predetermined ashlar configuration can be excavated much faster and simpler than by drilling holes and blasting with explosives. The media employed in the invention such as water for the high-pressure medium and air for the cooling medium are readily available, and the lance-like apparatus when made sufficiently narrow makes it possible also to work deep channels in granite. The alternation between heating effects upon impact of the point-like discrete jets of pressure medium on the rock and the cooling effect of cool media striking thereat results in an "embrittlement" of the rock, which is in contrast to previously known methods where, without the use of a cooling medium, a hard coating resulted which resisted the removal of granite material.

I claim:

1. A process for removing material from an object, the process having a pressure medium and means for directing said pressure medium at high pressure towards an impact area on said object perferably in the form of a plurality of discrete narrow jets, said narrow jets removing particles from said object to form a channel therein, the improvement comprising:

providing means for cooling said impact area of said object, said means for cooling having a cooling medium and a means for directing said cooling medium in the form of at least one guiding jet, and directing said at least one guiding jet relative to at least one of said narrow jets, said at least one guiding jet striking said impact area concurrently with said at least one narrow jet or striking said at least one narrow jet, said impact area being that area in contact with said narrow jet.

2. The process of claim 1, wherein said means for directing said pressure medium comprises a nozzle head, said nozzle head having a free end face and said free end face having a central area thereon, and further comprising the step of directing said narrow jets out of said nozzle head in the form of a bundle of jets, said bundle of jets having a substantially greater area density in said central area than outside of said central area.

3. The process of claim 1, further comprising the step of directing said at least one guiding jet to intersect at least an outermost jet of said narrow jets before striking said impact area of said object.

4. The process of claim 1 or 3, wherein said means for directing said pressure medium directs said narrow jets in the form of a bundle of jets, and further comprising the step of directing said at least one guiding jet of said cooling medium into said bundle of jets.

5. The process of claim 1, wherein said pressure medium is at least 1500 bars.

6. The process of claim 1, wherein said pressure medium is cool water.

7. The process of claim 1, wherein said cooling medium is air.

8. The process of claim 1, wherein said cooling medium is cold liquified gas.

9. The process of claim 1, further comprising the step of adding abrasive particles to said pressure medium.

10. The process of claim 1, further comprising the step of subjecting said pressure medium to pressure pulsations.

11. The process of claim 1, further comprising the step of subjecting said cooling medium to pressure pulsations.

12. An apparatus for removing material from an object, the apparatus having a pressure medium supplied to a nozzle head via a pressure medium supply conduit, said nozzle head having at least two nozzles, and being adapted to preferably direct said pressure medium in the form of narrow jets against an impact area of said object, the improvement comprising:

a cooling medium, a directional head and a cooling medium supply conduit that couples said cooling medium to said directional head, said directional head having at least one guiding nozzle, said at least one guiding nozzle having means for forming at least one guiding jet from said cooling medium, and having means for directing said at least one guiding jet relative to at least one of said narrow jets of said pressure medium, said at least one guiding jet of said cooling medium striking said impact area concurrently with said at least one narrow jet or striking said at least one narrow jet, said impact area being that area in contact with said narrow jet.

13. The apparatus of claim 12, wherein said at least two nozzles have a setting angle ($\beta$) that is between about 10° and 25°.

14. The apparatus of claim 1, wherein said pressure medium supply conduit is substantially flexible.

15. The apparatus of claim 12, wherein said pressure medium supply conduit is guided by a guide member in a rocking plane, said guide member being joined to said cooling medium supply conduit, and said cooling medium supply conduit being substantially rigid.

16. The apparatus of claim 12, further comprising that said nozzle head has opposed side surfaces and a receiving chamber provided within for receiving said pressure medium, and one side of said nozzle head having communicating ducts for communicating said at least two nozzles to said receiving chamber, and the other side of said nozzle head having a communicating duct for communicating said receiving chamber to said pressure medium supply conduit.

17. The apparatus of claim 16, further comprising that said at least two nozzles each have a tubular screw bolt, said tubular screw bolt being adapted to screw into an internally threaded portion of said nozzle head, said internally threaded portion leading to one of said communicating ducts of said one side of said nozzle head.

18. The apparatus of claim 17, further comprising that said tubular screw bolt has an annular insert, said annular insert fitting into said screw bolt being made of a hard material and having an opening, said opening having the smallest flow cross-section of all of said units which take part in conducting said pressure medium.

19. The apparatus of claim 18, further comprising that said screw bolt is provided with a stub, said stub having a flow cross-section that decreases conically in the direction of flow of said pressure medium.

20. The apparatus of claim 19, further comprising that said stub has an inlet, said inlet being covered by a disk having a plurality of perforation holes, and said plurality of perforation holes having an overall inside flow cross-section greater than said flow cross-section of said opening of said annular insert.

21. The apparatus of claim 18, wherein said hard material is sapphire or hard metals.

* * * * *

UNITED STATES PATENT AND TRADEMARK OFFICE

CERTIFICATE OF CORRECTION

PATENT NO. : 5,255,959

DATED : October 26, 1993

INVENTOR(S) : Charles Loegel

It is certified that error appears in the above-indentified patent and that said Letters Patent is hereby corrected as shown below:

Column 5, line 52, delete "opgionally" and insert --optionally--.

Column 6, line 61, delete "perferably" and insert --preferably--.

Column 8, line 11, delete "1" and insert --12--.

Signed and Sealed this

Twenty-eighth Day of June, 1994

*Attest:*

Bruce Lehman

BRUCE LEHMAN

*Attesting Officer*

*Commissioner of Patents and Trademarks*